United States Patent [19]

Lord

[11] Patent Number: 4,549,404

[45] Date of Patent: Oct. 29, 1985

[54] DUAL PUMP DOWN CYCLE FOR PROTECTING A COMPRESSOR IN A REFRIGERATION SYSTEM

[75] Inventor: Richard G. Lord, Liverpool, N.Y.

[73] Assignee: Carrier Corporation, Syracuse, N.Y.

[21] Appl. No.: 597,947

[22] Filed: Apr. 9, 1984

[51] Int. Cl.[4] ..... F25B 41/04

[52] U.S. Cl. ..... 62/224; 62/228.3

[58] Field of Search ..... 62/204, 205, 222, 224, 62/225, 226, 228.3, 157, 231, 158, 83, 174

[56] References Cited

U.S. PATENT DOCUMENTS 3,960,322 6/1976 Ruff et al. ..... 62/236 X 4,420,947 12/1983 Yoshino ..... 62/238.6 X

FOREIGN PATENT DOCUMENTS 2637210 2/1978 Fed. Rep. of Germany ..... 62/228.3

*Primary Examiner*—Harry B. Tanner

*Attorney, Agent, or Firm*—Robert H. Kelly

[57] ABSTRACT

A method and control system are disclosed for operating a refrigeration system to protect the refrigeration system compressor from flooding at startup of the refrigeration system. When the refrigeration system is to be shut down, refrigerant flow from a condenser to an evaporator of the refrigeration system is effectively closed off and the refrigeration system compressor is run for a first preselected time period sufficient to reduce the refrigerant pressure in the evaporator to a first desired, relatively low level. Then, prior to restarting the refrigeration system, the compressor is again run with the refrigerant flow from the condenser to the evaporator closed off to pump refrigerant out of the evaporator to reduce the refrigerant pressure in the evaporator to a second desired, relatively low level.- This dual pump down cycle ensures that no liquid refrigerant from the evaporator will enter the compressor when the refrigeration system is restarted.

2 Claims, 1 Drawing Figure

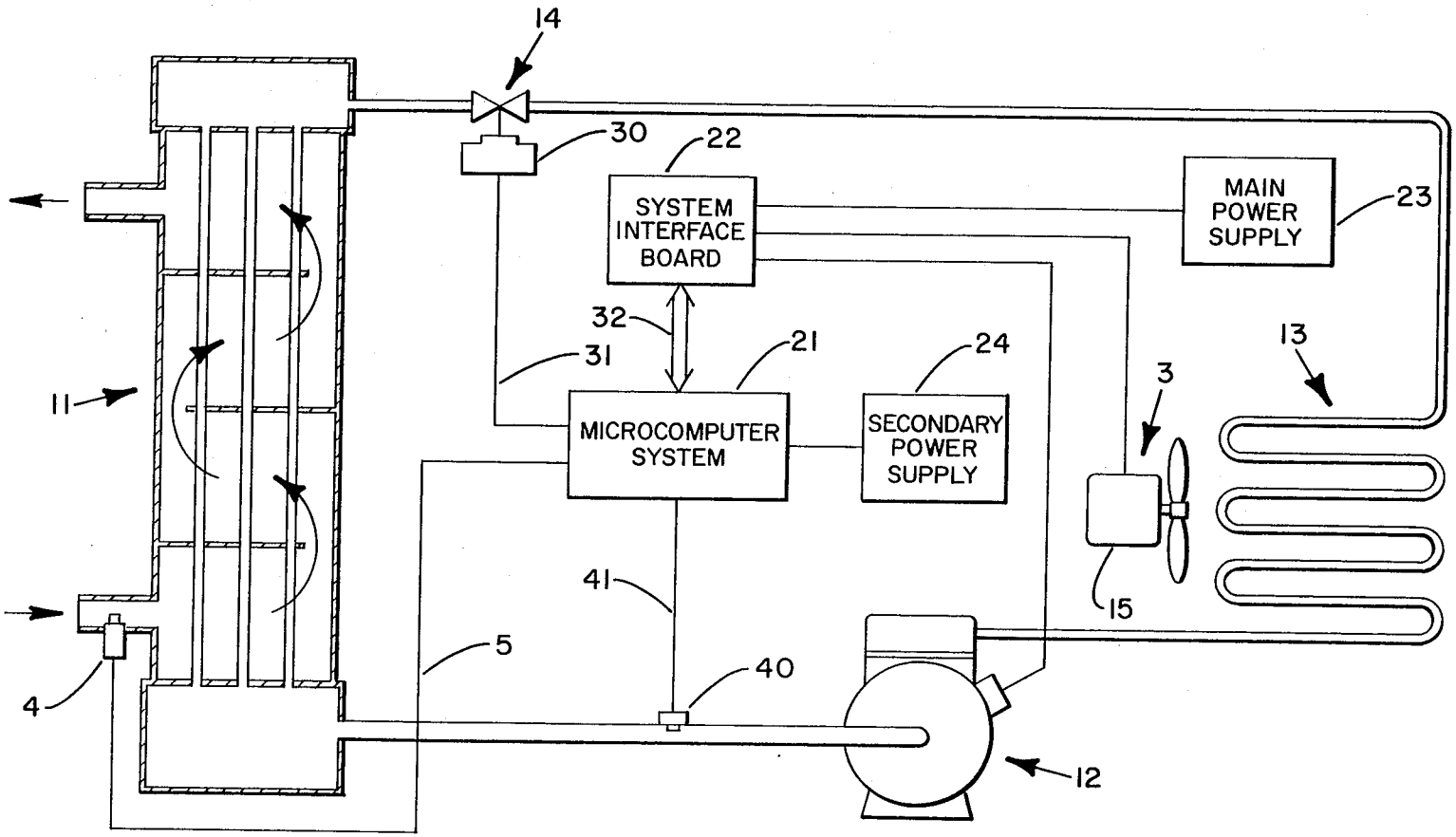
MAIN POWER SUPPLY
23
13
3
15
12
SECONDARY POWER SUPPLY
24
21
MICROCOMPUTER SYSTEM
40
SYSTEM INTERFACE BOARD
22
32
31
41
30
14
5
11
4

DUAL PUMP DOWN CYCLE FOR PROTECTING A COMPRESSOR IN A REFRIGERATION SYSTEM

BACKGROUND OF THE INVENTION

The present invention relates to refrigeration systems and, more particularly, relates to methods and control systems for protecting a refrigeration system compressor against flooding at startup of the refrigeration system.

Conventional refrigeration systems utilize a recirculating refrigerant for removing heat from a low temperature side of the refrigeration system and for discharging heat at a high temperature side of the refrigeration system. The work input necessary to operate the refrigeration system is provided by a motor driven compressor which receives low pressure gaseous refrigerant and compresses it to a high pressure. This high pressure gaseous refrigerant is supplied to a condenser where heat is removed from the gaseous refrigerant to condense it to a liquid. This liquid refrigerant is then supplied through an expansion valve to an evaporator wherein heat is transferred from a heat transfer fluid to the liquid refrigerant to evaporate the liquid refrigerant. The heat transfer fluid is thereby cooled and then used to cool a load, such as to cool a building. The evaporated refrigerant from the evaporator is returned to the compressor for recirculation through the refrigeration system.

During off periods of the refrigeration system, the refrigerant charge in the refrigeration system will usually migrate to the evaporator because the evaporator is usually the coldest spot (lowest pressure) in the refrigeration system. If the refrigeration system is started with a substantial amount of refrigerant in the evaporator, the liquid refrigerant in the evaporator may be pulled into the compressor in sufficient quantities to damage the compressor. That is, undesirable flooding of the refrigeration system compressor with liquid refrigerant from the evaporator may occur at startup of the refrigeration system if large enough quantities of refrigerant collect in the evaporator during an off period of the refrigeration system.

To protect refrigeration system compressors from flooding at startup of the refrigeration system, the refrigeration system may be operated with a pump down or pump out cycle. A pump down cycle comprises pumping the evaporator down to a relatively low pressure at the end of a run period of the refrigeration system to pull substantially all the refrigerant charge out of the evaporator. If the refrigeration system is only off for a short period this works well, but if the off period is relatively long then the pump down cycle may not be effective because refrigerant will gradually migrate back to the evaporator after completion of the pump down cycle. A pump out cycle comprises pumping the evaporator out whenever refrigerant pressure in the evaporator increases to a fixed set point. However, this can result in loss of lubricating oil for the compressor when the compressor is only operated for relatively short run times.

SUMMARY OF THE INVENTION

Therefore, it is an object of the present invention to simply, efficiently, and effectively protect a refrigeration system compressor against flooding at startup of the refrigeration system without adversely affecting overall operation of the refrigeration system.

This and other objects of the present invention are attained by a method and control system for operating a refrigeration system to provide a dual pump down cycle for removing refrigerant from an evaporator of the refrigeration system both after a shut down of the refrigeration system and prior to a startup of the refrigeration system. According to the present invention, a control system, preferably a microcomputer control system, monitors operation of the refrigeration system. When the refrigeration system is turned off during normal operation of the refrigeration system, for example, when the refrigeration system is turned off after having satisfied a load placed on the refrigeration system, the control system closes off refrigerant flow from the condenser to the evaporator of the refrigeration system. Then, the control system generates and supplies a first control signal to the refrigeration system compressor to run the compressor for a first selected time period to reduce the refrigerant pressure in the evaporator to a desired level after refrigerant flow from the condenser to the evaporator has been closed off by the control system. Also, prior to restarting the refrigeration system, the control system generates and supplies a second control signal to the refrigeration system compressor to run the compressor for a second selected time period to again reduce the refrigerant pressure in the evaporator to a desired level. This dual pump down cycle fully protects the refrigeration system compressor against flooding at startup of the refrigeration system without adversely affecting overall operation of the refrigeration system.

BRIEF DESCRIPTION OF THE DRAWING

Other objects and advantages of the present invention will be apparent from the following detailed description in conjunction with the accompanying drawing in which: The FIGURE is a schematic illustration of a refrigeration system with a control system for operating the refrigeration system according to the principles of the present invention.

DESCRIPTION OF THE PREFERRED EMBODIMENT

The FIGURE is a schematic illustration of a refrigeration system having a control system for operating the refrigeration system according to the principles of the present invention. As shown in the FIGURE, the refrigeration system comprises an evaporator 11, a compressor 12, an air cooled condenser 13, and an expansion valve 14, connected in the usual manner. Also, as shown in the FIGURE, the control system comprises a microcomputer system 21, a system interface board 22, a main power supply 23, and a secondary power supply 24.

The microcomputer system 21 may be any device, or combination of devices, suitable for receiving input signals, for processing the received input signals according to preprogrammed procedures, and for generating control signals in response to the processed input signals. The control signals generated by the microcomputer system 21 are supplied to control devices which control operation of the refrigeration system in response to the control signals provided to the control devices from the microcomputer system 21. For example, the microcomputer system 21 may be a model 8031 microprocessor with a model 2764 memory device which are available from Intel Corporation which has a place of business at 3065 Bowers Avenue, Santa Clara, Calif. 95051.

As shown in the FIGURE, the secondary power supply 24 is connected to the microcomputer system 21 so that the microcomputer system 21 controls electrical power flow from the secondary power supply 24 via electrical lines 31 to a motor 30 which opens and closes the expansion valve 14. Preferably, the expansion valve 14 is an incrementally adjustable electronic expansion valve having the capability of substantially completely closing off refrigerant flow from the condenser 13 to the evaporator 11 when the expansion valve 14 is moved to a fully closed position. Such an expansion valve is described in U.S. patent application Ser. No. 564,543 entitled "Incrementally Adjustable Electronic Expansion Valve" which was filed in the U.S. Patent and Trademark Office on Dec. 22, 1983 and which is assigned to the same assignee as the present patent application. Also, preferably, the expansion valve 14 is controlled in the manner disclosed in U.S. patent application Ser. No. 564,542 entitled "Control System For An Electronic Expansion Valve In A Refrigeration System" which was also filed in the U.S. Patent and Trademark Office on Dec. 22, 1983 and which is also assigned to the same assignee as the present patent application. The entire disclosures of the foregoing United States patent applications are incorporated herein by reference.

Further, as shown in the FIGURE, the system interface board 22 is connected by a ribbon cable 32 to the microcomputer system 21. The system interface board 22 includes switching devices for controlling electrical power flow from the main power supply 23 to a compressor motor for driving the compressor 12 and to a motor 15 for driving a condenser fan unit 3 for circulating cooling air over the condenser 13. Preferably, the switching devices are electronic components, such as relays, which are controlled in response to control signals from the microcomputer system 21 which are supplied through the ribbon cable 32 to the electronic components on the system interface board 22.

According to the present invention, the control system determines when to operate the refrigeration system to satisfy a load placed on the refrigeration system. More specifically, as shown in the FIGURE, the temperature of a heat transfer fluid, such as water, to be cooled by operation of the refrigeration system is sensed by a temperature sensor 4 and a signal indicative of this sensed temperature is provided via electrical lines 5 to the microcomputer system 21. The sensed temperature of the heat transfer fluid relative to a desired set point temperature for the heat transfer fluid determines the amount of compressor capacity required to match the load. The desired set point temperature is provided to the microcomputer system 21 from a set point setting device, such as a set point potentiometer (not illustrated in the FIGURE).

Preferably, the temperature sensor 4 is a temperature responsive resistance device such as a thermistor. However, as will be readily apparent to one of ordinary skill in the art to which the present invention pertains, many types of sensors may be employed as the temperature sensor 4. Generally, any type of temperature sensor may be used which is capable of providing a signal indicative of the sensed temperature to the microcomputer system 21.

The microcomputer system 21 processes the heat transfer fluid temperature signals provided from the temperature sensor 4 to the microcomputer system 21, and the signal provided from the set point setting device to the microcomputer system 21, to determine when to turn on the refrigeration system to satisfy the monitored load. In general, when it is desired to turn on the refrigeration system, the microcomputer system 21 supplies control signals via the ribbon cable 32 to appropriate switching devices on the system interface board 22 to close the switches so that electrical power flows from the power supply 23 through the system interface board 22 to the motor 15 driving the condenser fan unit 3 and to the motor driving the compressor 12 thereby turning on the fan unit 3 and the compressor 12. Also, at this time, the microcomputer system 21 operates to control electrical power flow from the secondary power supply 24 via the electrical lines 31 to the motor 30 which controls the position of the expansion valve 14. In this manner, the position of the expansion valve 14 is controlled by the microcomputer system 21.

Also, in general, when it is desired to turn off the refrigeration system, the microcomputer system 21 supplies control signals via the ribbon cable 32 to the switching devices on the system interface board 22 to open the switches to discontinue electrical power flow from the power supply 23 through the system interface board 22 to the motor 15 driving the condenser fan unit 3 and to the motor driving the compressor 12 thereby turning off the fan unit 3 and the compressor 12. Also, the microcomputer system 21 operates to control electrical power flow from the secondary power supply 24 via the electrical lines 31 to the motor 30 driving the expansion valve 14 to move the expansion valve 14 to its fully closed position thereby effectively preventing refrigerant flow from the condenser 13 to the evaporator 11 when the refrigeration system is turned off.

However, according to the present invention, each time the refrigeration system is shut down (turned off) as described above, the control system operates to pump refrigerant out of the evaporator 11 to reduce the refrigerant pressure in the evaporator 11 to a preselected level after the expansion valve 14 is moved to its fully closed position at shutdown. This is accomplished by the microcomputer system 21 supplying a control ignal via the ribbon cable 32 to the appropriate switching device on the system interface board 22 to maintain the electrical power flow from the power supply 23 through the system interface board 22 to the motor driving the compressor 12 for a period of time after the expansion valve 14 is moved to its fully closed position at shutdown. The compressor 12 is allowed to run for a first, preselected, fixed time period, with the expansion valve 14 in its fully closed position, to pump refrigerant out of the evaporator 11 to reduce the refrigerant pressure in the evaporator 11 to a first desired level. After the compressor 12 has run for this first, preselected, fixed time period, the microcomputer system 21 generates a control signal which is supplied via the ribbon cable 32 to open the appropriate switching device on the system interface board 22 to discontinue the flow of electrical power from the power supply 23 through the system interface board 22 to the motor driving the compressor 12 thereby terminating operation of the compressor 12.

Further, according to the present invention, each time it is desired to restart (turn on) the refrigeration system, for example, when the temperature sensor 4 detects a new load to be satisfied by operation of the refrigeration system, the microcomputer system 21 provides another control signal via the ribbon cable 32 to the appropriate switching device on the system interface board 22 to again supply power from the power supply 23 through the system interface board 22 to the motor driving the compressor 12 to turn on the compressor 12 while maintaining the expansion valve 14 in its fully closed position. The compressor 12 runs for a second, preselected fixed time period under the control of the microcomputer system 21 to pump refrigerant out of the evaporator 11 to again reduce the refrigerant pressure in the evaporator 11 to a second desired level. After the compressor 12 has run for the second, preselected fixed time period the control system then allows normal operation of the refrigeration system to resume, preferably, by initially opening the expansion valve 14 at a relatively slow rate compared to the rates at which the expansion valve 14 is usually opened and closed in response to refrigeration system operating conditions. In this manner, flooding of the compressor 12 with liquid refrigerant from the evaporator 11 is effectively prevented since the refrigerant pressure in the evaporator 11 is twice reduced to a relatively low level prior to any restart of the refrigeration system to ensure that undesirable amounts of refrigerant which could cause flooding are not accumulated in the evaporator 11.

It should be noted that, according to the present invention, the first pump down cycle just after turning off the refrigeration system may be for the same amount (period) of time as the second pump down cycle just prior to turning on the refrigeration system. However, this is not critical and, if desired, these time periods may be different. Also, it should be noted that instead of operating the compressor 12 for a preselected fixed time period for each pump down cycle, the compressor 12 may be run until the refrigerant pressure in the evaporator 11 is reduced to a preselected level. For example, as shown in the FIGURE, a pressure sensor 40 may be located in the refrigerant line connecting the evaporator 11 to the compressor 12 to sense the refrigerant pressure in this portion of the refrigerant circuit. A signal indicative of this sensed pressure is supplied via electrical lines 41 to the microcomputer system 21. The time periods of the pump down cycle for the compressor 12 are then determined by the microcomputer system 21 detecting when the pressure sensed by the pressure sensor 40 falls below a preselected desired level.

Also, it should be noted that it is not essential to use an incrementally adjustable electronic expansion valve as the expansion valve 14. For example, a conventional expansion valve 14 may be used with a conventional liquid line solenoid valve for closing off the refrigerant flow from the condenser 13 to the evaporator 11 when the refrigeration system is turned off. The features and advantages of the present invention are attained by the control system of the present invention coordinating the opening and closing of the liquid line solenoid valve with the dual pump cycle operation of the present invention in the same manner that this operation is coordinated with operation of an incrementally adjustable electronic expansion valve as described above.

However, it should be noted that if an incrementally adjustable electronic expansion valve is used as the expansion valve 14 then refrigerant flow from the condenser 13 to the evaporator 11 may be more efficiently and effectively controlled after startup of the refrigeration system to further aid in preventing flooding of the compressor 12 at startup. For example, after the second pump down cycle is completed prior to beginning normal operation of the refrigeration system, the expansion valve 14 may be controlled to be stepped open at a relatively slow rate to allow relatively gradual flow of refrigerant from the condenser 13 to the evaporator 11 for a certain amount of time after the startup of the refrigeration system. For example, an incrementally adjustable electronic expansion valve 14 may be initially stepped open under the control of the microcomputer system 21 at a relatively slow, fixed rate compared to a variable rate at which the valve 14 would normally be opened in response to refrigeration system operating conditions. Then, when the expansion valve 14 reaches a particular preselected open position, the microcomputer system 21 controls the expansion valve 14 to respond to the normal refrigeration system operating conditions.

Of course, the foregoing description is directed to a preferred embodiment of the present invention and various modifications and other embodiments of the present invention will be readily apparent to one of ordinary skill in the art to which the present invention pertains. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A method of operating a refrigeration system including a compressor for compressing gaseous refrigerant supplied to the compressor from an evaporator and including an expansion valve for controlling refrigerant flow from a condenser to the evaporator, comprising:

driving the expansion valve to a fully closed position to substantially prevent refrigerant flow from the condenser to the evaporator whenever the refrigeration system is shut down;

running the refrigeration system compressor for a first preselected amount of time sufficient to reduce the refrigerant pressure in the evaporator to a first desired level after the expansion valve is driven to its fully closed position by the step of driving; and running the refrigeration system compressor for a second preselected amount of time sufficient to reduce the refrigerant pressure in the evaporator to a second desired level while maintaining the expansion valve in its fully closed position prior to restarting the refrigeration system after a shut down.

2. A control system for operating a refrigeration system including a compressor for compressing gaseous refrigerant supplied to the compressor from an evaporator which receives refrigerant from a condenser, comprising:

an expansion valve for controlling refrigerant flow from the condenser to the evaporator, said expansion valve having a fully closed position which substantially prevents refrigerant flow from the condenser to the evaporator; and a control means for turning the refrigeration system off and on, for moving the expansion valve to its fully closed position whenever the refrigeration system is turned off, for generating and supplying a first control signal to the refrigeration system compressor to run the compressor for a first preselected time period sufficient to reduce refrigerant pressure in the evaporator to a first desired level whenever the refrigeration system is turned off and the expansion valve is moved to its fully closed position by said control means, and for generating and supplying a second control signal to the refrigeration system compressor to run the compressor, while maintaining the expansion valve in its fully closed position, for a second preselected time period sufficient to reduce the refrigerant pressure in the evaporator to a second desired level prior to said control means turning on the refrigeration system.

* * * * *